US012637814B2

(12) United States Patent
Braun

(10) Patent No.: US 12,637,814 B2
(45) Date of Patent: May 26, 2026

(54) TRANSITION STRUCTURE FOR BRIDGING A STRUCTURAL JOINT

(71) Applicant: Maurer Engineering GmbH, Munich (DE)

(72) Inventor: Christian Braun, Holzkirchen (DE)

(73) Assignee: Maurer Engineering GmbH, Munich (DE)

( * ) Notice: Subject to any disclaimer, the term of this patent is extended or adjusted under 35 U.S.C. 154(b) by 971 days.

(21) Appl. No.: 17/796,555

(22) PCT Filed: Jan. 29, 2021

(86) PCT No.: PCT/EP2021/052078
§ 371 (c)(1),
(2) Date: Jul. 29, 2022

(87) PCT Pub. No.: WO2021/152072
PCT Pub. Date: Aug. 5, 2021

(65) Prior Publication Data

US 2023/0046504 A1 Feb. 16, 2023

(30) Foreign Application Priority Data

Jan. 29, 2020 (DE) ..... 10 2020 201076.5

(51) Int. Cl.
*E01D 19/06* (2006.01)
*E01B 11/56* (2006.01)

(52) U.S. Cl.
CPC ..... *E01D 19/062* (2013.01); *E01B 11/56* (2013.01); *E01D 19/065* (2013.01); *E01B 2202/025* (2013.01)

(58) Field of Classification Search
CPC ..... E01D 19/065; E01D 19/06; E01D 19/062; E01B 11/56
See application file for complete search history.

(56) References Cited

U.S. PATENT DOCUMENTS 2,013,195 A * 9/1935 Ward ..... E01D 19/065 14/73.1
4,030,156 A * 6/1977 Raymond ..... E01D 19/062 404/69

(Continued)

FOREIGN PATENT DOCUMENTS

CN 201567528 U 9/2010
CN 108699786 A 10/2018

(Continued)

OTHER PUBLICATIONS

Office Action (and translation) issued in Japanese Application No. 2022-545433, dated Aug. 30, 2023.

(Continued)

*Primary Examiner* — Abigail A Risic
(74) *Attorney, Agent, or Firm* — IceMiller LLP

(57) ABSTRACT

A transition structure for bridging a structural joint between two structure parts of a structure is provided. The transition structure has at least two trusses mounted on the edges of the structure and at least one slat displaceably mounted thereon, wherein a primary sliding surface is arranged between at least one truss and at least one slat. The primary sliding surface has at least two partial sliding surfaces, which are each arranged in mutually angled sliding planes, the sliding planes meeting in a common line of intersection S which forms an axis of movement A along which the slat can move relative to the truss. At least one sliding plane is arranged at an oblique angle to a plane of movement B of the transition structure.

33 Claims, 8 Drawing Sheets

(56) References Cited

U.S. PATENT DOCUMENTS

| | | | | |
|---|---|---|---|---|
| 4,674,912 | A * | 6/1987 | Buckenauer | E01D 19/062 404/63 |
| 5,302,050 | A | 4/1994 | Buckenauer et al. | |
| 6,609,265 | B1 * | 8/2003 | Jee | E01D 19/06 14/73.1 |
| 7,845,853 | B2 | 12/2010 | Rudy et al. | |
| 10,119,274 | B2 | 11/2018 | Braun | |
| 10,501,899 | B2 | 12/2019 | Braun | |
| 2005/0244228 | A1 * | 11/2005 | Bradford | E01D 19/062 404/25 |
| 2008/0148499 | A1 * | 6/2008 | Bradford | E01D 19/062 14/73.5 |
| 2010/0281807 | A1 * | 11/2010 | Bradford | E01D 19/062 52/393 |
| 2013/0019551 | A1 * | 1/2013 | Bradford | E01D 19/062 52/309.1 |
| 2016/0289967 | A1 * | 10/2016 | Braun | E04C 3/02 |
| 2022/0282434 | A1 * | 9/2022 | Hoffmann | E01D 19/062 |

FOREIGN PATENT DOCUMENTS

| | | | | |
|---|---|---|---|---|
| CN | 110331660 | A | | 10/2019 |
| DE | 2746490 | A1 | | 4/1979 |
| DE | 69500386 | T2 | | 1/1998 |
| EP | 338124 | A | * | 10/1989 |
| EP | 0338124 | A2 | | 10/1989 |
| EP | 669427 | A1 | * | 8/1995 |
| JP | 55-081108 | A | | 6/1980 |
| JP | 60-261808 | A | | 12/1985 |
| JP | 05132906 | A | * | 5/1993 |
| JP | 2000-213590 | A | | 8/2000 |
| JP | 3449661 | B2 | | 9/2003 |
| JP | 2008-542638 | A | | 11/2008 |
| JP | 2009144429 | A | * | 7/2009 |
| JP | 2016-514775 | A | | 5/2016 |
| KR | 10-1998406 | B1 | | 7/2019 |
| UA | 116698 | C2 | | 4/2018 |
| WO | WO-2015120993 | A2 | * | 8/2015 E04B 1/681 |

OTHER PUBLICATIONS

Examination Report issued in Australian Application No. 2021215022, dated Sep. 21, 2023.

Office Action (and translation) issued in UA Application No. 2022 02622, issued Jun. 12, 2024 [9 pages].

International Search Report for PCT/EP2021/052078, dated Apr. 14, 2021.

First IPER (International Preliminary Examination Report) for PCT/EP2021/052078, dated Jan. 5, 2022.

Petition in Answer to First IPER, dated Apr. 5, 2022.

Second IPER (International Preliminary Examination Report) for PCT/EP2021/052078, dated May 6, 2022.

Chapter II Request for PCT/EP2021/052078, dated Nov. 29, 2021.

First Office Action issued in Chinese Application No. 202180011630. 7, dated Feb. 28, 2025 (and translation) [20 pages].

* cited by examiner

TRANSITION STRUCTURE FOR BRIDGING A STRUCTURAL JOINT

CROSS-REFERENCE TO RELATED APPLICATIONS

This application is a National Stage of International Patent Application No. PCT/EP2021/052078, filed on Jan. 29, 2021, which claims priority to German Patent Application No. DE 10 2020 201 076.5, filed on Jan. 29, 2020, the disclosures of which are incorporated by reference in their entireties.

The present invention relates to a transition structure for bridging a structural joint between two structure parts of a structure.

Transition structures of the type usually have at least two trusses mounted on the edges of the structure and at least one slat displaceably mounted thereon, a primary sliding surface being arranged between at least one truss and at least one slat.

Such transition structures for bridging a structural joint are in principle sufficiently known from the state of the art.

Transition structures of this type are mainly used for roadway crossings, in particular in road and railroad bridge construction, when relative displacements of the structure parts are to be made possible in addition to the required load transfer. The basic principle is that the trusses are arranged transverse to the structural joint and thus bridge it. The trusses can be mounted on at least one part of the structure so that they can be moved or telescoped so that corresponding movements of the two parts of the structure relative to each other are compensated without stresses in the trusses. One or more slats are mounted transversely to the trusses and close the gap between the two parts of the structure to such an extent that vehicles and people can safely bridge the joint. The slats are spaced approximately evenly horizontally from one another by a control system and are mounted so that they can be moved relative to the trusses below. This allows the transition structure to adapt flexibly to varying dimensions of the structural joint. This ensures safe bridging of the structural joint at all times. At the same time, damage to the building and the transition structure due to excessive stresses and loads can be avoided.

In order to achieve precise guidance of the slats along the longitudinal axis of the trusses, sliding bearings have so far been used in their intersection points. In this case, the sliding bearing is preferably attached to the slat so that there is a primary sliding surface of both components between the sliding bearing and the truss. This primary sliding surface is aligned horizontally in order to transmit vertical loads from the slat via the sliding bearing to the truss and at the same time allow displacement of the slat relative to the truss. Preferably, the sliding bearing engages around both sides of the truss from above or lies in a correspondingly shaped groove so that, in addition to the horizontal primary sliding surface, two vertical guiding surfaces are formed between the sliding bearing and the truss. When a horizontal load is applied parallel to the longitudinal axis of the truss, the slat can thus move relative to the truss along the latter. Any horizontal loads acting transversely to the longitudinal axis of the truss, on the other hand, are transmitted in the area of the vertical guiding surfaces between the slat and the truss.

Although any orientations of surfaces, axes and loads are described herein as horizontal or vertical for simplicity, they are not limited with respect to a horizontal or vertical plane or direction in the strict sense. In the present disclosure, such indications of orientation refer only to the plane of movement of the transition structure or bridge. The plane of movement is spanned at an intersection point of the truss with the slat, for example, by the axis of movement of the slat along the truss and the longitudinal axis of the slat or a corresponding parallel line. This is especially true if the transition structure is installed at an angle. Thus, in this case, the orientation of the horizontal primary sliding surface may differ from a horizontal plane in the narrower sense and accordingly may also be inclined. The same applies to the vertical guiding surfaces arranged perpendicularly thereto and correspondingly described load effects.

The slats can additionally be mounted rotatably relative to the crossbars at the respective intersection point. A kinematic control principle makes it possible to rotate around the vertical axis with as little resistance as possible. Such kinematic control principles are used, for example, in the "Maurer swivel joist" for roadway crossings for road bridges or also the "Maurer guided cross-tie" for railroad bridge construction. A preferably elastic rotatability around the two horizontal axes allows the adaptation to tolerances and expansion differences as well as the interchangeability of the wear parts with simultaneous transmission of the live loads.

The transmission of the torques, for example from the horizontal loads induced at the road surface from braking and starting, is usually effected by the aforementioned torsional resistance of the sliding bearings about the horizontal axes, by additional guided sliding elements underneath the truss or by support elements independent of these.

In the known transition structures, there is therefore a functional separation between vertical and horizontal load transfer at the intersection point of a slat with a truss. While the vertical loads are absorbed by the truss via the horizontal primary sliding surface, horizontal loads acting transversely to the longitudinal axis of the truss are transmitted in the area of the vertical guiding surfaces between the slat and the truss. Point 6.8 of the DIN EN 1337-2:2004 standard for structural bearings specifies that the primary sliding surface must be dimensioned in such a way that no gap occurs in its state of use. In contrast to bridge bearings, the effects on transition structures are almost exclusively variable. As a result, the basic load from dead weight is missing and the verification of no gap cannot usually be fulfilled despite the biasing of the sliding elements. For this reason, sliding materials are also used for the primary sliding surface, which are normally only intended for guiding and exhibit increased wear behavior and increased sliding resistance.

According to the DIN EN 1990:2010-12 standard for the basis of structural design, the state of use extends up to and including the serviceability limit state. If the serviceability limit state is exceeded, the specified conditions for the serviceability of a structure or a component are no longer fulfilled. Thus, limit states that affect the function of the structure or one of its parts under normal states of use or the well-being of the users or the appearance of the structure are also to be classified as serviceability limit states.

In the case of special transition structures designed for extreme cases such as an earthquake, the state of use may therefore still be present when the extreme case occurs. This also applies in particular to the state after any emergency and buffer functions that are only used in extreme cases have been triggered. Here, for example, a calculated lifting of the sliding plate from the intermediate bearing part is intended during the state of use.

Despite this proven principle of load transfer, it has been found that large quantities of dust, dirt or other foreign bodies can accumulate in the area of the sliding surfaces, especially during long-term use of such transition structures.

If regular maintenance of the transition structures is not carried out, this can lead to increased wear of the sliding material or to impairments in the sliding behavior of the transition structures. This is primarily due to the fact that with such functional separations between vertical and horizontal load transfer, there is a certain amount of play between the respective components of the guiding, which cannot be avoided in principle. Thus, a gap occurs in the area of the vertical guiding surfaces when the transition structure is in use. This play or gap also causes edge compression in the area of the guiding surfaces. The result is uneven load transmission within the transition structures, which can lead to increased and uneven wear of the sliding material. In addition, the guiding surfaces can only be lubricated initially due to the clearance, and a permanent supply of lubricant cannot be guaranteed. In addition, a sliding material must be used that can absorb high local compression. Thus, sliding materials are ultimately used here that exhibit relatively poor sliding behavior due to relatively high coefficients of friction. This results in less than optimum control behavior of the corresponding transition design.

Although the main horizontal sliding surface is free of play, the above-mentioned disadvantages also apply here due to the gap resulting from the load combination and the suitable sliding material, which is initially lubricated at best.

It is thus the task of the present invention to provide an improved transition design which, on the one hand, is as simple as possible and, on the other hand, operates as long as possible without maintenance and reliably even under increased loads, so that costs and effort during manufacture and during operation can be reduced.

The solution of the aforementioned problem is achieved according to the invention with a transition construction according to claim 1. Advantageous further embodiments of the invention result from dependent claims 2 to 31.

The transition structure according to the invention is thus characterized in that the primary sliding surface has at least two partial sliding surfaces, each of which is arranged in mutually angled sliding planes, the sliding planes meeting in a common line of intersection which forms an axis of movement along which the slat can move relative to the truss. In this regard, at least one sliding plane is arranged at an oblique angle to a plane of movement of the transition structure. In the present disclosure, a mutually skewed arrangement is understood to mean a mutually non-parallel and non-orthogonal arrangement of the corresponding elements.

The two angled sliding surfaces of the primary sliding surface combine the functions of vertical and horizontal load transfer between the slat and the crossbar. Thus, any vertical loads as well as horizontal loads acting transversely to the axis of movement can be absorbed by the primary sliding surface of the transition structure. The vertical guiding surfaces previously used are therefore no longer necessary, as their functions are fully performed by the primary sliding surface. This considerably simplifies the design of the transition structure. Manufacturing costs can be reduced accordingly. The installation space, which in some cases is only available to a limited extent, can also be significantly reduced. In addition, the omission of the lateral vertical guiding surfaces eliminates the need to provide a guide clearance. This greatly reduces the amount of dirt and foreign matter entering the sliding surface. This design means that conventional sliding materials can be used in the primary sliding surfaces for bridge bearings.

With the continuous and uniform compression in the area of the primary sliding surface, permanently lubricated sliding materials in particular are now also suitable for guidance, as known, for example, from the DIN EN 1337-2:2004 standard for structural bearings. These have a low coefficient of friction and are particularly low-wear. In tests carried out by the applicant, it has already been possible to establish resistance with corresponding sliding materials at a cumulative sliding distance in the present leading primary sliding surface that is up to 25 times higher than in the previously separate guiding surfaces.

In addition, the two partial sliding surfaces, which are inclined to each other, enable continuous self-centering of the slat on the truss in relation to the axis of movement. The slat is thus optimally positioned relative to the truss at all times and possible edge compression along the axis of movement can be avoided. There is no longer any bearing play due to vertically aligned guiding surfaces.

Advantageously, the two sliding planes include a first angle selected such that no gap occurs in the area of the primary sliding surface during the state of use of the transition structure. In other words, a transition structure is provided without a gap in all sliding surfaces between the truss and the slat in the area of the intersection point during the state of use.

The ratio between the maximum possible vertical load and horizontal load in this area of the transition structure can be optimally adjusted by the inclination of the two partial sliding surfaces relative to each other or the selection of the first angle. With the appropriate choice of the inclination of the two partial sliding surfaces relative to each other, a gap in the area of the primary sliding surface can thus be avoided even with maximum horizontal load in combination with the corresponding minimum vertical load when the transition structure is in use. At the same time, a sliding material with the lowest possible friction can be used in the area of the primary sliding surface.

Preferably, the primary sliding surface has exactly two, most preferably only two partial sliding surfaces. In this way, the transition structure according to the invention is as simple as possible. The two partial sliding surfaces can, for example, form a continuous primary sliding surface that is only bent once in the region of the axis of movement. Here, in addition to the two mutually angled sliding planes, the two partial sliding surfaces thus also intersect along the axis of movement. Alternatively, the two partial sliding surfaces can also be formed separately from each other in the respective sliding planes.

Preferably, the two sliding planes are arranged so that the line of intersection runs parallel to a longitudinal axis of a truss. Thus, the axis of movement is also parallel to a longitudinal axis of a truss. With this configuration, the entire transition structure is loaded as uniformly as possible in terms of load transfer. Furthermore, the slat can move uniformly with identical resistance in both directions of the axis of movement.

Advantageously, several primary sliding surfaces are arranged along a truss and form a common axis of movement. The common axis of movement of all primary sliding surfaces allows the slat to move along the truss with as little resistance as possible. In addition, the truss has the simplest possible structure, which can reduce the effort and cost of manufacturing. Preferably, the plurality of primary sliding surfaces also have common sliding planes. In this way, the truss can be formed uniformly along its longitudinal axis. The design of the truss is further simplified and manufacturing costs are reduced.

The first angle is selected in such a way that in the ultimate limit state of the transition structure, no gap occurs in the area of the primary sliding surface. If the loads on the transition structure are increased further from the state of use, the ultimate limit state occurs. According to the DIN EN 1990:2010-12 standard for basis of structural design, this state is related to collapse or other forms of structural failure. Thus, those limit states that concern the safety of people and/or the safety of the structure are also to be classified as ultimate limit states. This has the advantage that even in this state it is still ensured that no gap occurs in the area of the primary sliding surface.

Preferably, the truss has at least one sliding plate in the area of the primary sliding surface. The sliding plate is preferably made of metal such as copper, steel, aluminum or stainless steel. By attaching the sliding plate in the area of the primary sliding surface, the friction between the truss and the slat can be reduced. Likewise, material wear in this area of the truss is prevented. The sliding plate, on the other hand, can simply be replaced with a new one after appropriate wear.

Advantageously, the truss itself is made of a sliding material, preferably metallic, as a counter surface. Any sliding plates or the like can thus be omitted from the truss in the area of the primary sliding surface.

Preferably, the primary sliding surface has a permanently lubricated sliding material, preferably with PTFE, UHMWPE, POM and/or PA. In one embodiment, the sliding material is provided, for example, in the form of a lubricated sliding disk, which preferably has at least one lubrication pocket in which the lubricant can be stored and evenly dispensed. Thus, a sliding material with a particularly low coefficient of friction can be provided. The wear of the sliding material can also be significantly reduced. It would also be conceivable to have a sliding material in the form of sliding pads attached to the slat.

Advantageously at least two partial sliding surfaces angled relative to one another are arranged in such a way that the corresponding sliding planes form the shape of a pitched roof. The pitched roof is designed in such a way that the line of intersection or the axis of movement forms the ridge of the pitched roof. The shape of a pitched roof has the particular advantage that any accumulation of dirt and foreign bodies in the region of the at least two partial sliding surfaces angled towards each other can be avoided as far as possible. This applies in particular in the area of the line of intersection or the axis of movement, since this represents the uppermost point of the pitched roof as the roof ridge.

Preferably, at least two partial sliding surfaces angled towards each other are arranged in such a way that the corresponding sliding planes form the shape of an upside-down pitched roof. Here, too, the pitched roof is designed in such a way that the line of intersection or the axis of movement forms the ridge of the pitched roof. Due to the upside-down roof shape, it is possible to make the slat or corresponding connection components stronger at the point of highest load near the axis of movement without requiring further installation space in the vertical direction. Thus, despite increased loads, installation space can again be saved.

Preferably, at least two partial sliding surfaces angled towards each other are formed symmetrically with respect to a plane of symmetry running through the line of intersection in the vertical direction to the plane of movement. The symmetrical arrangement of the at least two partial sliding surfaces improves the self-centering of the slat on the truss along the axis of movement. In addition, it is advantageous, particularly in the case of balanced load application or load transfer from all sides, if the conditions for displacement of the slat relative to the truss in both directions along the axis of movement are as equal as possible. In addition, the transition structure is simple in design and thus cost effective to manufacture. Alternatively, the cross-sectional areas of the two partial sliding surfaces could also be designed to be of different sizes so that, depending on the first angle and the expected load ratios, an optimum surface pressure is established for friction and durability.

Advantageously at least one sliding plane is further inclined relative to the plane of movement by a second angle of between 10 degrees and 60 degrees, preferably 45 degrees. Particularly with a steeper second angle, correspondingly high horizontal loads can be absorbed transverse to the axis of movement by the respective angled partial sliding surface. At the same time, it is nevertheless possible to use a sliding material with a low friction value in the area of the primary sliding surface. On the one hand, this prevents that a gap occurs in the area of the primary sliding surface. On the other hand, movement of the slat relative to the truss along the axis of movement is ensured with as little resistance as possible. The different sliding planes can have an identical second angle. It would also be possible to use different second angles to adapt the transition structure to different load effects.

Preferably, the first angle is between 60 degrees and 160 degrees, preferably 90 degrees. Particularly with a more acute first angle, correspondingly high horizontal loads can be absorbed transverse to the axis of movement by the respective angled partial sliding surfaces. At the same time, it is nevertheless possible to use a sliding material with a low friction value in the area of the primary sliding surface. On the one hand, this prevents that a gap occurs in the area of the primary sliding surface. On the other hand, it ensures that the slat moves relative to the truss along the axis of movement with as little resistance as possible.

Preferably, the transition structure has at least one intersection point at a slat with a truss, at which a sliding bearing, preferably rotatable about an axis vertical to the plane of movement, with a support plate is arranged between the truss and the slat, the primary sliding surface extending between the truss and the support plate. Through the sliding bearing between the slat and the truss, vertical and horizontal loads can be selectively transmitted via the support plate. Should the sliding bearing be a rotatable sliding bearing, the slat can perform both twisting and sliding movements relative to the truss at the intersection point. In this case, rotatability about the vertical axis with as little resistance as possible enables a kinematic control principle.

Preferably, the support plate is designed to be deformable so that the primary sliding surface has at least one partial sliding surface that is horizontal to the plane of motion, depending on the magnitude of load application. If the sliding planes form the shape of a pitched roof, high bending stresses are generated in the support plate. The load-bearing capacity of the system can be increased by adding a further, horizontal partial sliding surface, which is only applied or forms when the support plate is deformed accordingly.

Advantageously the bearing has a base plate via which the sliding bearing is fastened to the slat. Preferably, the slat or the base plate has a first trunnion by means of which the sliding bearing is rotatably attached to the slat. By means of the base plate, the sliding bearing can be designed to be as stable as possible. The first trunnion, on the other hand, enables appropriate rotation of the sliding bearing about its vertical axis.

Advantageously, the sliding bearing further has an elastomeric layer arranged between the support plate and the base plate. The elastomeric layer provides a flexible buffer function between the base plate and the support plate. Thus, for example, the elastomeric layer enables the base plate to be displaced, tilted and/or also twisted relative to the support plate. In this way, minor movements between the truss and the slat can be compensated. In addition, the elastomeric layer has damping properties.

Preferably, the sliding bearing has at least one shear surface arranged in a plane between the support plate and the base plate, the plane being arranged at an oblique angle to the sliding planes of the mutually angled partial sliding surfaces. Preferably, the sliding bearing has the same number of sliding planes as the number of mutually angled partial sliding surfaces at the intersection point. If an elastomeric layer is used, this is arranged at least in the area of the shear surface. The different inclinations of the partial sliding surfaces and thrust surfaces allow optimum adjustment of the adaptation behavior. This is particularly the case in conjunction with the elastomeric layer and an arrangement of the sliding planes of the partial sliding surfaces angled towards each other in the form of an upside-down pitched roof.

Advantageously the transition structure comprises in the region of at least one intersection point a bracket arranged on the slat with a biasing unit with a sliding material, preferably a sliding spring. The bracket and the biasing unit are designed in such a way that the slat is biased at the intersection point relative to the truss and is mounted so as to be displaceable and/or rotatable about the axis vertical to the plane of movement. Primarily, the biasing unit ensures that sufficient vertical load can be built up to absorb the horizontal loads without causing lifting in the area of the sliding surfaces. Furthermore, the biasing unit can be used to adjust the movement of the slat relative to the truss. Finally, the slat can be positioned even more precisely relative to the truss by means of a further connection point between the slat and the truss.

Preferably, the biasing unit is designed to be guide-neutral for movements of the slat relative to the truss along the primary sliding surface. Preferably, the biasing unit has no vertical guiding surfaces. In this case, therefore, there are also no horizontal loads acting on the biasing unit that are oriented transversely to the truss longitudinal axis. In this case, the slat is guided on the truss along the axis of movement only by the partial sliding surfaces of the primary sliding surface, which are angled relative to one another. With the omission of the guiding surfaces, rotary movements of the truss about the vertical axis are made possible via the sliding surface of the biasing unit. By appropriately selecting the biasing load and the first angle between the two angled partial sliding surfaces on the sliding bearing, it is also possible to prevent the sliding bearing from gaping in the state of use. This reduces the sliding resistance and the biasing unit can be manufactured at low cost.

Advantageously the bracket has a second trunnion via which the biasing unit is rotatably attached to the bracket. The first trunnion and the second trunnion form a common axis of rotation so that the slat is rotatably mounted about the axis of rotation relative to the truss at the intersection point. The interaction of the first and second trunnions allows the slat to be precisely rotated relative to the slat at the intersection point. The second trunnion is used in particular when the biasing unit has any guiding surfaces.

Preferably, the sliding material of the biasing unit comprises a permanently lubricated sliding material, preferably with PTFE, UHMWPE, POM and/or PA. In one embodiment, the sliding material is provided, for example, in the form of a lubricated sliding disk, which preferably has at least one lubrication pocket in which the lubricant can be stored and evenly dispensed. This provides a sliding material with a particularly low coefficient of friction. The wear of the sliding material can also be significantly reduced.

Preferably, the biasing unit has a screw for biasing the biasing unit in an installed state. For example, the screw engages with the bracket for this purpose. Alternatively, the biasing unit is designed in such a way that it can be installed biased and relieved to a predetermined biasing dimension in an installed state. This allows the desired biasing dimension to be set as easily and flexibly as possible.

Advantageously, the transition structure has at least one truss box in which one end of the truss is displaceably and/or rotatably mounted. In principle, such truss boxes are arranged at the respective mounting points of the truss in the area of the structure parts and, in particular, provide buffer space for any kind of movements of the truss. In this way, any movements of the two parts of the structure in relation to each other can be compensated.

Preferably, the end of the truss has at least one bore and the truss box has at least one trunnion via which the end of the truss is rotatably mounted in the truss box. It would also be possible for the truss box to have at least one bore and the end of the truss to have at least one trunnion in order to support the truss accordingly. In both cases, the truss is supported in the truss box as simply and efficiently as possible.

Preferably, the truss box has an upper sliding bearing arranged above the truss, wherein a primary sliding surface designed as described above is arranged between the upper sliding bearing and the truss. With the aid of the upper sliding bearing, the movements of the truss can be precisely guided within the truss box. Advantageously, the upper sliding bearing is a sliding spring. The sliding spring serves as a biasing unit to bias the truss relative to an underlying lower sliding bearing and thus adjust the freedom of movement of the truss within the truss box. The lower sliding bearing does not perform any guiding functions. The sliding spring prevents the truss from lifting off within the truss box. The advantages of the primary sliding surface according to the invention described above apply accordingly.

Advantageously, the upper sliding bearing is further rotatably attached to the truss box. For this purpose, the upper sliding bearing or the corresponding sliding spring preferably comprises a trunnion that is fastened in the truss box. Thus, both displacements and rotations of the truss can be made possible at the support point of the truss. It would also be conceivable for the truss to be biased relative to the underlying structural bearing in such a way that only a rotational movement is enabled and a sliding movement, on the other hand, is prevented.

Advantageously, the transition structure is a swivel truss design for general roadway transitions. In this case, the slats are mounted so that they can be displaced and rotated on swiveling roadway trusses, some of which are arranged at an angle. This creates an advantageous kinematic control principle so that the transition structure can adapt particularly flexibly to different dimensions of the structural joint and varying load effects.

Alternatively, the transition structure can also be designed as a guided cross-tie design in railroad bridge construction. The guided cross-tie design is essentially based on the kinematic control principle of the swivel truss design. In addition, it is designed to guide a railroad track across the structural joint. In this case, for example, the slats can be designed as displaceable railroad ties. Alternatively, it would also be conceivable for the railroad ties to be arranged on the slats.

Advantageously, several, preferably two, primary sliding surfaces are arranged between a truss and a slat, the axes of movement of which differ from one another. This makes it possible to increase the overall primary sliding surface between the slat and the truss in a very simple manner. The entire primary sliding surface is thus designed for even higher loads acting on the transition structure. The risk of a gap is further reduced. In addition, the slat can be guided even more precisely relative to the truss thanks to the multiple axes of movement.

It can be useful if the axes of movement run parallel to each other and are preferably arranged in the plane of movement of the transition structure or in a plane parallel thereto. The parallelism of the movement axes to one another means that increased friction or edge compression in the primary sliding surfaces can be avoided. As a result, the slat can move with as little resistance as possible relative to the truss. The same applies to the advantageous arrangement of the axes of movement relative to the plane of movement of the transition structure. In addition, the transition structure has a particularly simple design.

In the following, advantageous embodiments of the present invention will now be described schematically with reference to figures, wherein FIG. 1 is a side view of a transition structure according to a first embodiment of the present invention;

Identical components in the various embodiments are marked with the same reference signs.

Figure 1:
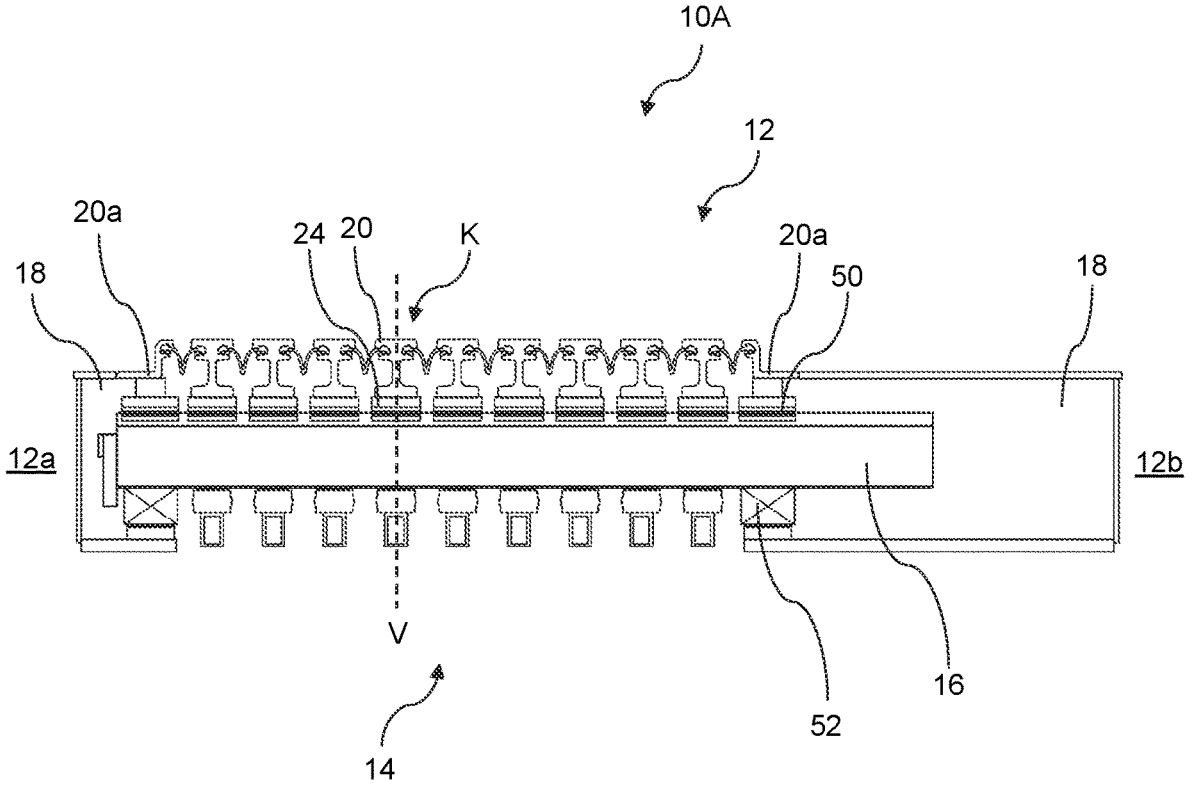

FIG. 1 shows the schematic structure of a transition structure 10A according to a particularly advantageous embodiment. The transition structure 10A has three trusses 16 which are arranged between two structure parts 12*a* and 12*b* of the structure 12 and thus bridge the structural joint 14 between the two structure parts 12*a* and 12*b*. In this regard, the trusses 16 are each supported at their ends in a truss box 18 of the transition structure 10A. Thus, the transition structure 10A has a total of six such truss boxes 18 formed at the structure edges of the corresponding structure parts 12*a* and 12*b* of the structure 12. The transition structure 10A shown is formed as a pivoting truss structure. Thus, the trusses 16 are here all rotatably and longitudinally slidably supported in the respective truss boxes 18. Such a support point can be realized, for example, by a lower sliding bearing 52 arranged below the truss 16 and an upper sliding bearing 50 arranged above the truss 16. The upper sliding bearing 50 is designed as a sliding spring that can rotate about its vertical axis. The trusses 16 are mounted in the truss boxes 18 on the structure part 12*a* so as to be displaceable in their longitudinal direction with only a small play. This allows rotational movements of the truss 16 to be compensated for. It would also be possible for one end of a truss 16 to be held fixedly, while merely being rotatable, in the truss box 18. For example, the truss 16 could have a bore and the truss box 18 could have a trunnion to support the end of the truss 16 accordingly (not shown).

Further, the transition structure 10A has nine slats 20 and two edge slats 20*a*, the two edge slats 20*a* being fixedly connected to the corresponding truss boxes 18. The slats 20 and edge slats 20*a* are spaced apart and slidably mounted on the trusses 16. Thus, at each intersection point K of a slat 20 with a truss 16, a primary sliding surface 22 is located between the two components. In this embodiment, the primary sliding surface 22 is configured to allow the slat 20 to move along the longitudinal axis of the truss 16 relative thereto at the intersection point K. In addition, the slat 20 is rotatably mounted at the intersection point K relative to the truss 16 about the vertical axis V. For this purpose, a rotatable sliding bearing 24 is arranged between the slat 20 and the truss 16 at the respective intersection points K. The sliding bearing 24 is rotatably attached to the upper side of the slat 20 and rests on the lower side of the truss 16. Thus, the primary sliding surface 22 extends here between the sliding bearing 24 and the truss 16.

Figure 2:
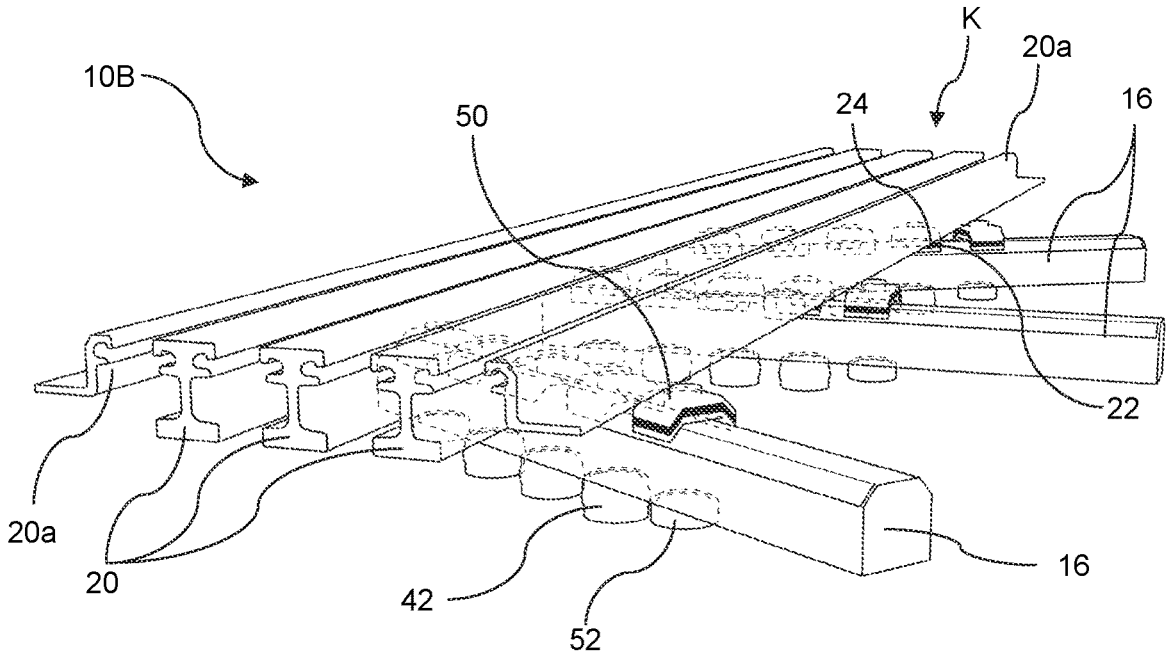
FIG. 2 is a perspective view of a portion of a transition structure according to a second embodiment.
Figure 3:
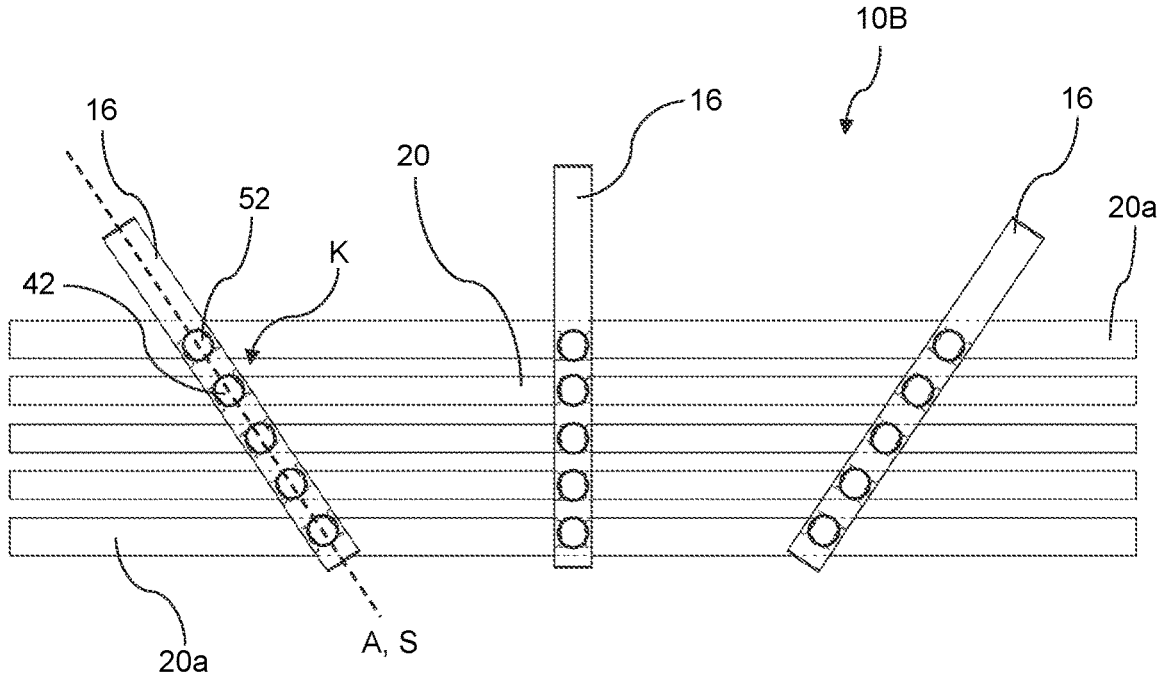
FIG. 3 is a schematic bottom view of the transition structure shown in FIG. 2.

FIGS. 2 and 3 show a perspective view of a portion of a transition structure 10B according to a second embodiment. The transition structure 10B is substantially the same as the transition structure 10A of the first embodiment. The identical components will not be further discussed below.

The transition structure 10B differs only in that it has only three slats 20 and two edge slats 20*a*. As can be seen, in particular, from the bottom view of FIG. 3, in this embodiment the central truss 16 is mounted rectangular to the construction joint axis and thus also rectangular to the slats 20 and edge slats 20*a*. The two outer trusses 16, on the other hand, are aligned at an angle to the slats 20 and edge slats 20*a*.

Figure 4:
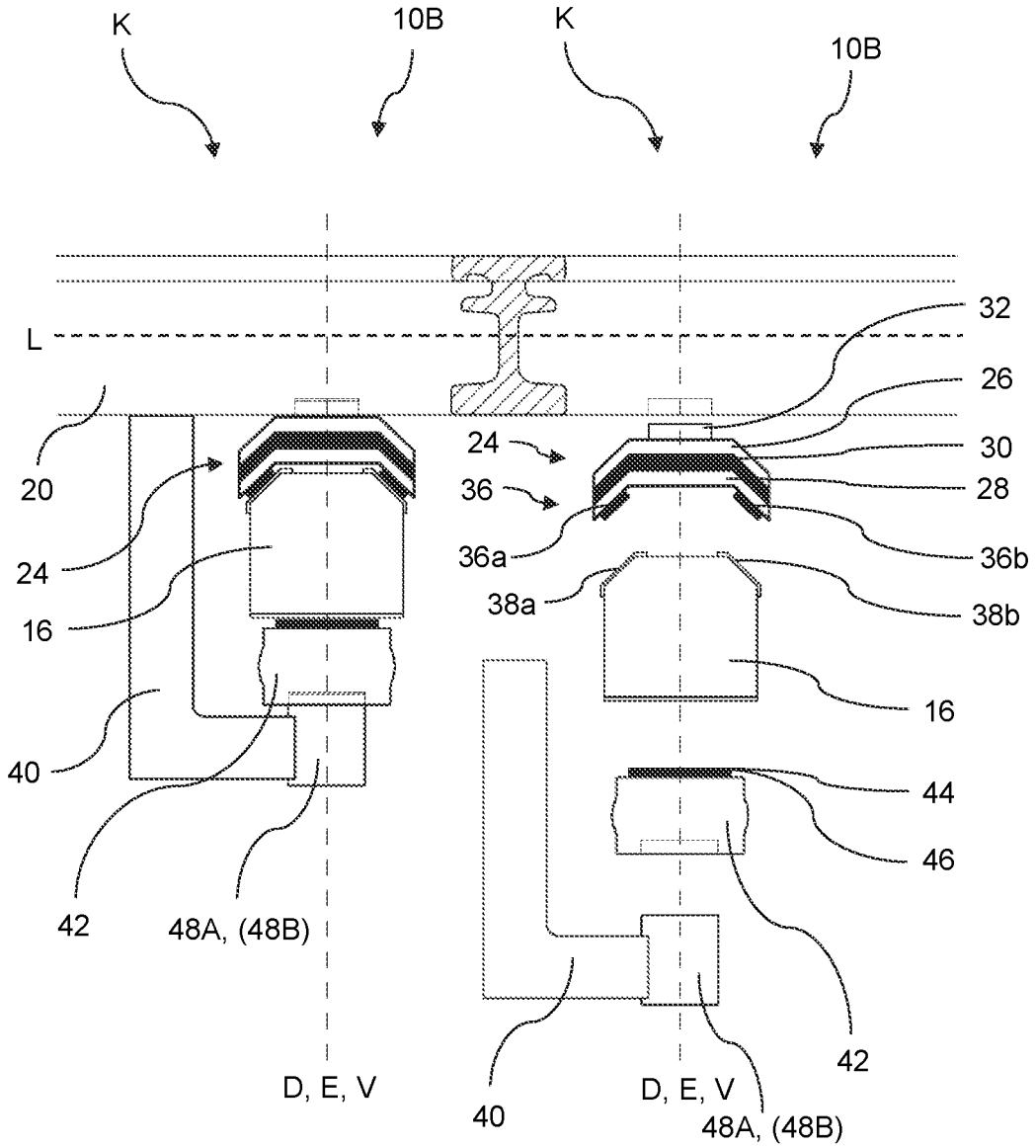
FIG. 4 is a side view and exploded view of an intersection point of a slat with a truss of the transition structures shown in FIGS. 1 and 2.
Figure 5:
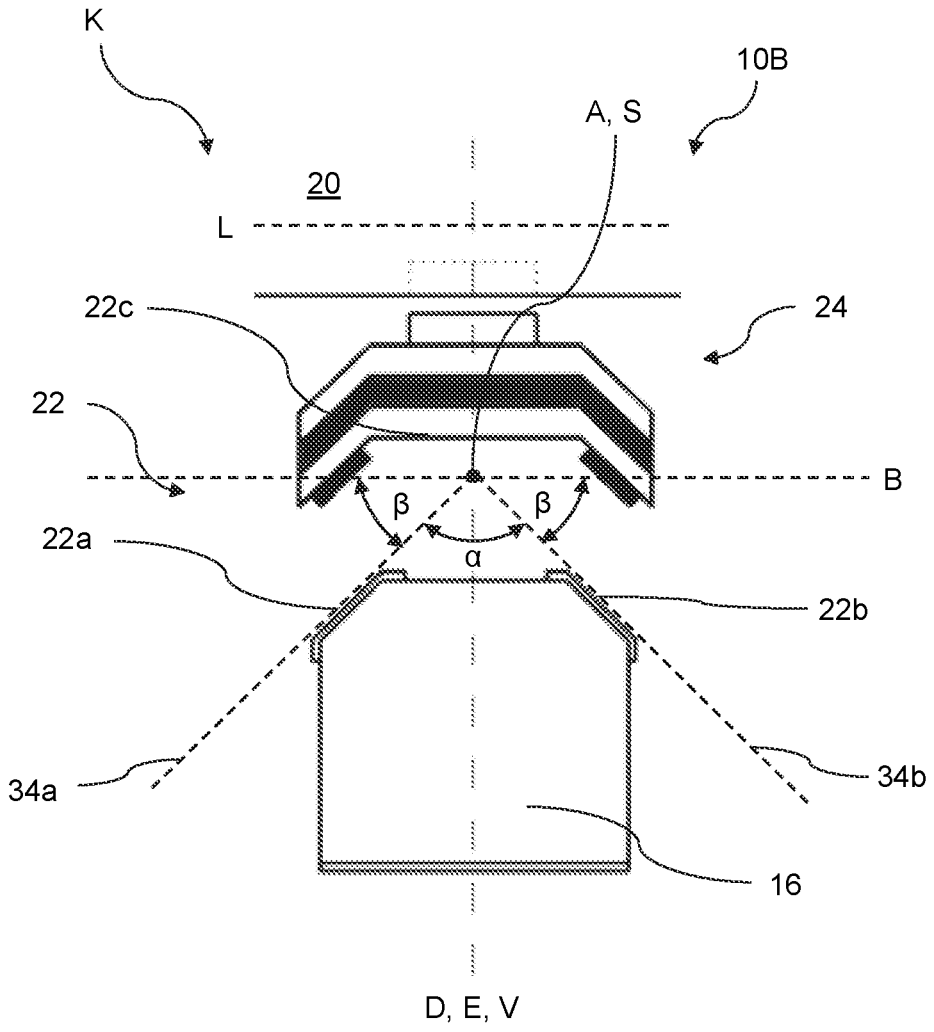
FIG. 5 is a section of the exploded view shown in FIG. 4.

In FIGS. 4 and 5, an intersection point K of a slat 20 with a truss 16 is shown in more detail as an example. As can be seen in particular from FIG. 5, the sliding bearing 24 includes a base plate 26, a support plate 28, and an elastomeric layer 30 therebetween. The base plate 26 includes a first trunnion 32, by means of which the sliding bearing 24 is attached to the slat 20 so as to be rotatable about the vertical axis V of rotation. Alternatively, the slat 20 may include the trunnion 32 (not shown). The support plate 28, on the other hand, rests on the cross-member 16 so that the actual primary sliding surface 22 is located between the support plate 28 and the truss 16.

The primary sliding surface 22 includes two partial sliding surfaces 22*a* and 22*b*, each arranged in mutually angled sliding planes 34*a* and 34*b*. In this regard, the two sliding planes 34*a* and 34*b* meet at a common line of intersection S that forms an axis of movement A along which the slat 20 can move relative to the truss 16. The two sliding planes 34*a* and 34*b* are arranged at an oblique angle to a movement plane B of the transition structure 10A, 10B. At the intersection point K, the plane of movement B is spanned by the axis of movement A and a line parallel to the longitudinal axis L of the slat 20. In this embodiment, the plane of movement B corresponds to the horizontal. All horizontal and vertical alignments of components and load actions described here therefore also refer to the plane of movement B. The two sliding planes 34*a* and 34*b* are arranged so that the line of intersection S is parallel to the longitudinal axis of the truss 16. This allows the slat 20 to move uniformly relative to the truss 16 along both directions of the axis of movement A.

The two partial sliding surfaces 22*a* and 22*b* are arranged in such a way that the corresponding sliding planes 34*a* and 34*b* form the shape of a pitched roof. Here, the axis of movement A is to be understood as the ridge of the pitched roof. Furthermore, the two partial sliding planes 22*a* and 22*b* are of the same size and are formed symmetrically with respect to each other in relation to a symmetry plane E running through the line of intersection S in the vertical direction. It would also be conceivable to dimension the two partial sliding surfaces 22*a* and 22*b* differently (not shown) in order to design them for different loads in each case.

In addition, the primary sliding surface 22 includes a sliding material 36 to reduce friction between the slat 20 and the truss 16. In the present case, the support plate 28 includes a sliding pad 36*a* and 36*b* in the area of each of the two partial sliding surfaces 22*a* and 22*b* for this purpose. Both sliding pads 36*a* and 36*b* include a permanently lubricated sliding material such as PTFE. It would also be possible to use UHMWPE, POM and/or PA here. In addition, the truss 16 includes a sliding plate 38*a* and 38*b* made of stainless steel in the area of each of the two partial sliding surfaces 22*a* and 22*b*. The two sliding pads 36*a* and 36*b* thus rest on the sliding plates 38*a* and 38*b* to slide along them. This can reduce friction between the support plate 28 and the truss 16, as well as wear on the sliding material 36. Alternatively, lubricated polymer sliding disks with prefabricated lubrication pockets could be used here. For example, the truss 16 could also be made of a metallic sliding material. In this case, the two sliding plates 38*a* and 38*b* could also be omitted.

The special arrangement of the primary sliding surface 22 or the two partial sliding surfaces 22*a* and 22*b* allows a functional combination of vertical and horizontal load transfer. On the one hand, vertical loads can be absorbed via the two partial sliding surfaces 22*a* and 22*b* and transferred from the slat 20 to the truss 16. The same applies to horizontal loads directed transversely to the axis of movement A. Thus, on the other hand, these can also be absorbed by the two partial sliding surfaces 22*a* and 22*b* and transferred accordingly between the slat 20 and the truss 16.

The ratio of absorbable vertical loads and horizontal loads transverse to the axis of movement A can be adjusted by the inclination of the two partial sliding surfaces 22*a* and 22*b* or the corresponding two sliding planes 34*a* and 34*b*. Thus, both sliding planes 34*a* and 34*b* include a first angle $\alpha$ selected such that no gap occurs in the area of the primary sliding surface 22 in the state of use of the transition structure 10A, 10B. The first angle $\alpha$ is even selected such that no gap occurs in the area of the primary sliding surface 22 even in the ultimate limit state of the transition structure 10A, 10B. In this embodiment, the first angle $\alpha$ is 90 degrees. However, if the transition structure 10A, 10B is to be designed for horizontal loads of lesser magnitude, a more obtuse first angle $\alpha$ can also be used.

Alternatively or additionally, the inclination of the two sliding planes 34*a* and 34*b* can also be indicated by their intersection angle with respect to the plane of movement B of the transition structure 10A, 10B. Thus, both sliding planes 34*a* and 34*b* are angled or inclined downwardly relative to the plane of movement B by a second angle $\beta$. In the present embodiment, both sliding planes 34*a* and 34*b* have the same second angle $\beta$, which here is 45 degrees. However, a somewhat flatter second angle $\beta$ can also be selected in the case of horizontal loads of lesser magnitude.

Furthermore, the transition structure 10A, 10B has a bracket 40 with a biasing unit 42 in the area of the intersection point K. The bracket 40 is attached to the slat 20. Furthermore, the bracket 40 and the biasing unit 42 are configured such that the slat 20 is biased, displaceable and rotatable about the vertical axis V at the intersection point K relative to the truss 16 by means of the biasing unit 42. In this embodiment, the biasing unit 42 is designed as a sliding spring. The sliding spring is attached to the underside of the truss 16, so that a horizontal sliding surface 44 is located between the sliding spring and the truss 16. However, the sliding spring does not have any guiding surfaces. This enables the rotational movements about the vertical axis V.

In the area of the horizontal sliding surface 44, the sliding spring contains a sliding material 46 in the form of a lubricated sliding disk with PTFE. However, the use of UHMWPE, POM and/or PA would also be conceivable. Furthermore, the sliding disk has several prefabricated lubrication pockets in which the lubricant can be stored and evenly distributed in the area of the horizontal sliding surface 44.

Furthermore, the bracket 40 includes a rigid connecting element 48A. The connecting element 48A may alternatively be formed as a second trunnion 48B, via which the sliding spring is rotatably attached to the bracket 40. This is advantageous, for example, if the biasing unit 42 has any guiding surfaces adjacent the horizontal sliding surface 44. In this case, the first trunnion 32 of the sliding bearing 24 and the second trunnion 48B of the bracket 40 form a common axis of rotation D. As a result, the slat 20 is mounted so as to be rotatable about the axis of rotation D, and thus about the vertical axis V, relative to the truss 16 at the intersection point K. Thus, despite preload, the degrees of freedom between the slat 20 and the truss 16 provided by the sliding bearing 24 are not further restricted.

In the present embodiment, the primary sliding surfaces 22 form a common axis of movement A at all intersection points K along a truss 16. In addition, the corresponding partial sliding surfaces 22*a* and 22*b* lie in the same sliding planes 34*a* and 34*b*. Thus, the truss 16 has a constant cross-section along its longitudinal axis in the sliding region. This can simplify the construction of the transition structure 10A, 10B and reduce costs in manufacturing.

The support plate 28 is designed to be deformable in the event of high loads being applied. Thus, if sufficiently high loads are applied to the support plate 28, its horizontal section comes into contact with a horizontal section of the truss 16. As a result, the primary sliding surface 22 has a further horizontal partial sliding surface 22*c* between the support plate 28 and the truss 16.

The advantages of the primary sliding surface 22 according to the invention can also be applied to the bearing of the trusses 16 in the truss boxes 18. As mentioned further above, the trusses 16 are received in the respective truss box 18 via an upper sliding bearing 50 or a corresponding sliding spring and a lower sliding bearing 52. Thus, the truss 16 can be biased relative to the lower sliding bearing by means of the slide spring. The sliding spring can be rotatably attached to the ceiling of the truss box 18 via a trunnion. In this embodiment, however, the trunnion is attached to the underside of the edge slat 20*a*, which adjoins the ceiling of the truss box 18. In addition, the sliding spring rests on the truss 16. Thus, between the sliding spring and the truss 16 there is another primary sliding surface as described previously.

Figure 6:
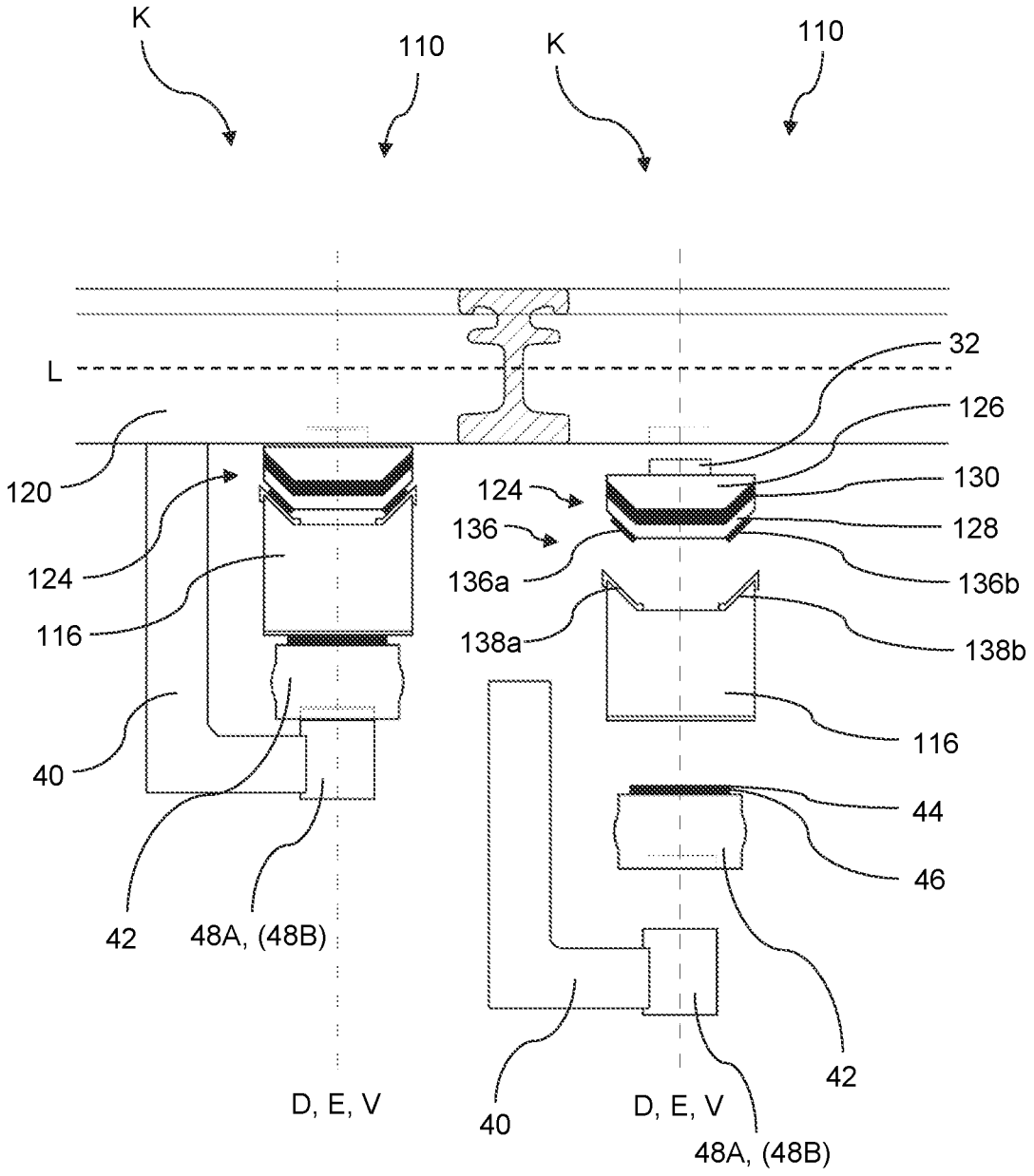
FIG. 6 is a side view and exploded view of an intersection of a slat with a truss of a transition structure according to a third embodiment of the present invention.
Figure 7:
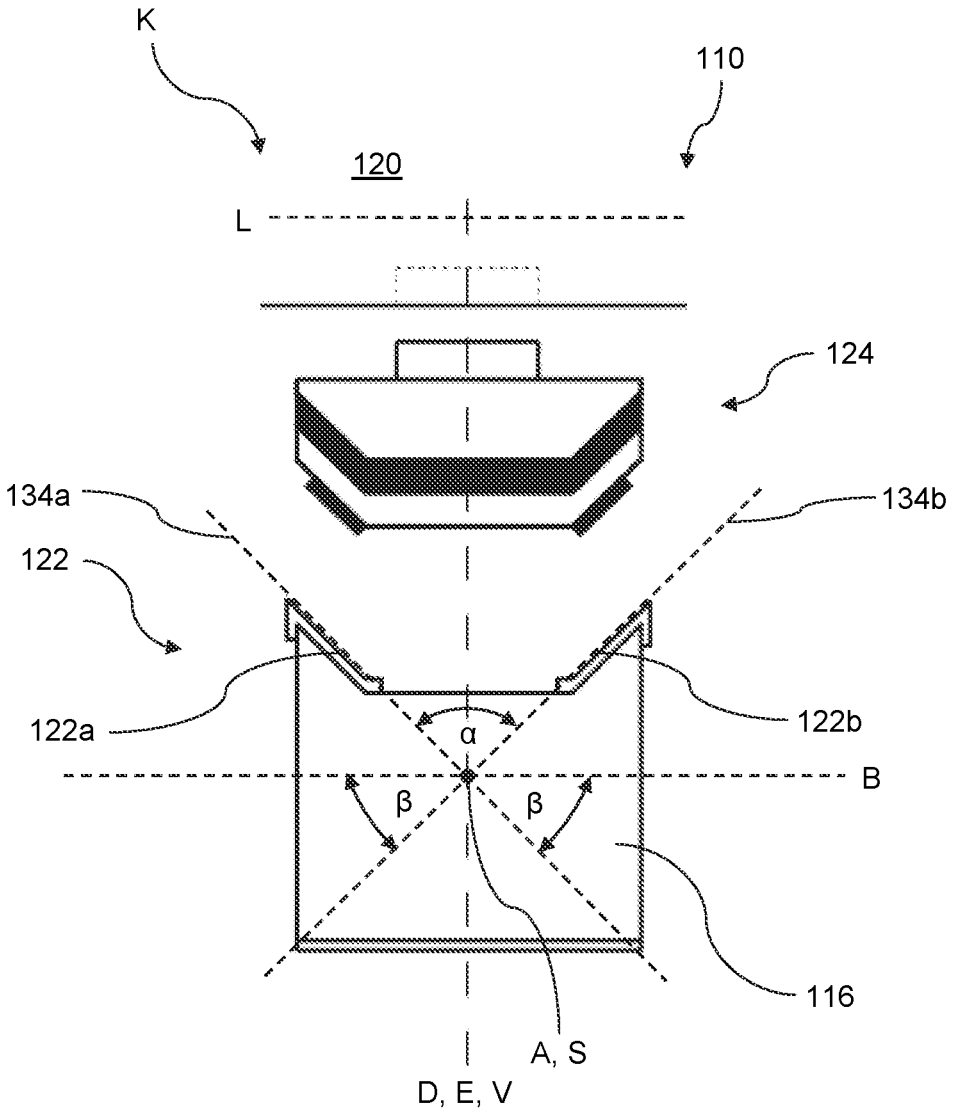
FIG. 7 is a section of the exploded view shown in FIG. 6.

In FIGS. 6 and 7, an intersection point K of a slat 120 and a truss 116 of a transition structure 110 according to a third embodiment of the present invention is illustrated. The transition structure 110 is substantially the same as the transition structure 10B of the second embodiment. The identical components will not be further discussed below.

However, the transition structure 110 differs from the transition structure 10B of the second embodiment in that the primary sliding surface 122 between the slat 120 or the sliding bearing 124 and the truss 116 is configured differently. Here, the two partial sliding surfaces 122*a* and 122*b* angled towards each other are arranged such that the corresponding sliding planes 134*a* and 134*b* form the shape of an upside-down pitched roof. Here, too, the axis of movement A forms the ridge of the pitched roof. The design of the components arranged in the area of the primary sliding surface 122, such as the sliding plates 138*a* and 138*b* and the sliding pads 136*a* and 136*b*, has been adapted accordingly. The same applies to the components of the sliding bearing 124, such as the base plate 126, the elastomeric layer 130 and the support plate 128. Their basic functions, however, remain as described above.

The advantages of this embodiment correspond essentially to those of the second embodiment. In addition, the sliding bearing 124 can be designed to be stronger at the most highly stressed center in the area of the axis of rotation D than in the peripheral area without requiring further installation space in the vertical direction. Furthermore, in this embodiment the point of zero torque, i.e. the intersection point of the three loads at right angles to the sliding surface in the biasing unit 42 or sliding spring and the sliding bearing 124, is shifted upwards to the height of the slat 120. This improves the torsional stiffness at the intersection point K.

Figure 8:
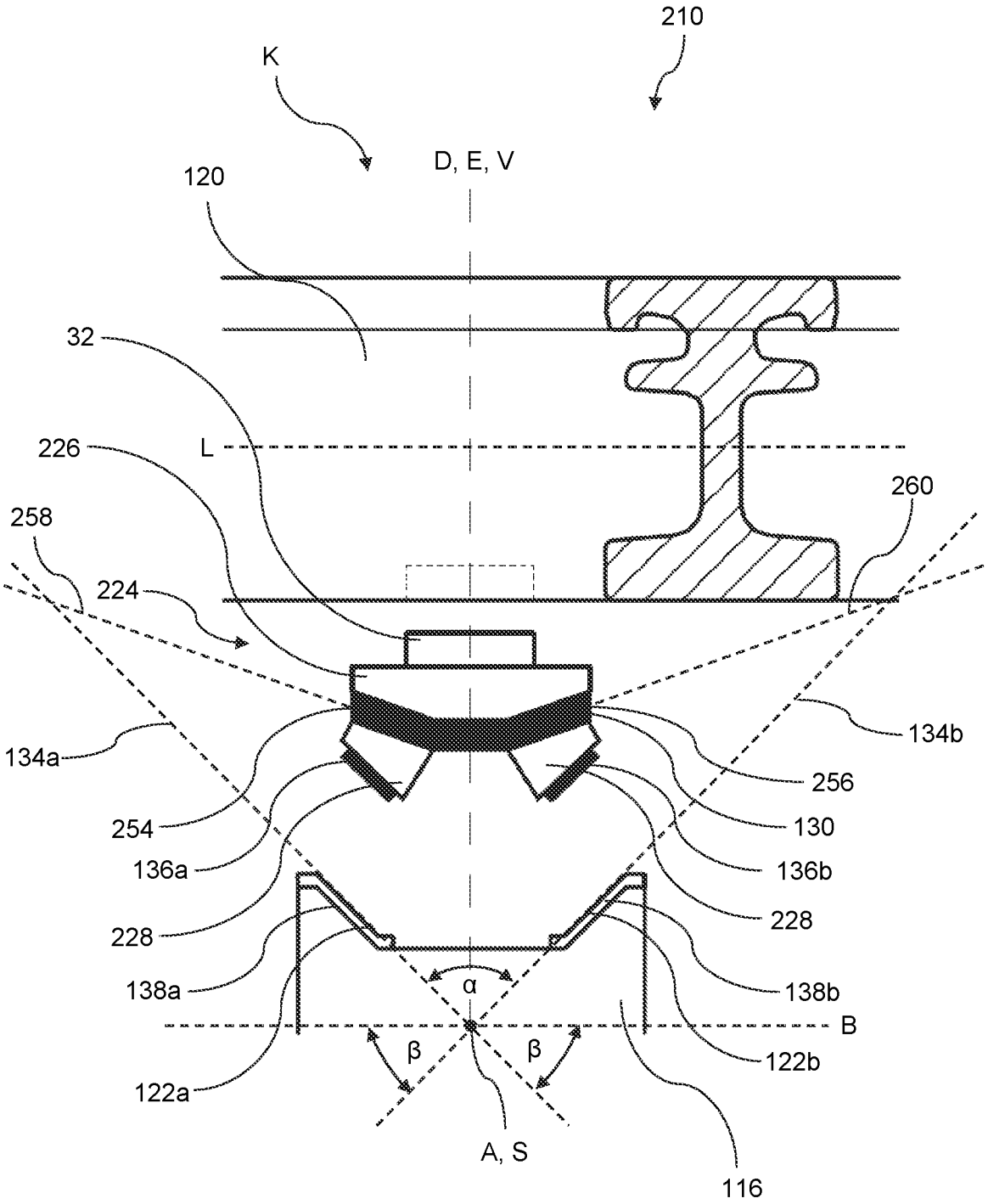
FIG. 8 is a section of an intersection point K of a transition structure according to a fourth embodiment.

In FIG. 8, a section of an intersection point K of a slat 120 and a truss 116 of a transition structure 210 according to a fourth embodiment of the present invention is shown. The transition structure 210 is substantially the same as the transition structure 110 of the third embodiment. The identical components will not be further discussed below.

However, the transition structure 210 differs in that it has a different sliding bearing 224. Here, the support plate 228 is formed in two pieces. In addition, the sliding bearing 224 has two shear surfaces 254 and 256, each of which is arranged in a plane 258 and 260 between the support plate 228 and the base plate 226. In this regard, the two planes 258 and 260 are arranged at an oblique angle to the sliding planes 134*a* and 134*b* of the partial sliding surfaces 122*a* and 122*b*, which are angled relative to one another.

Figure 9:
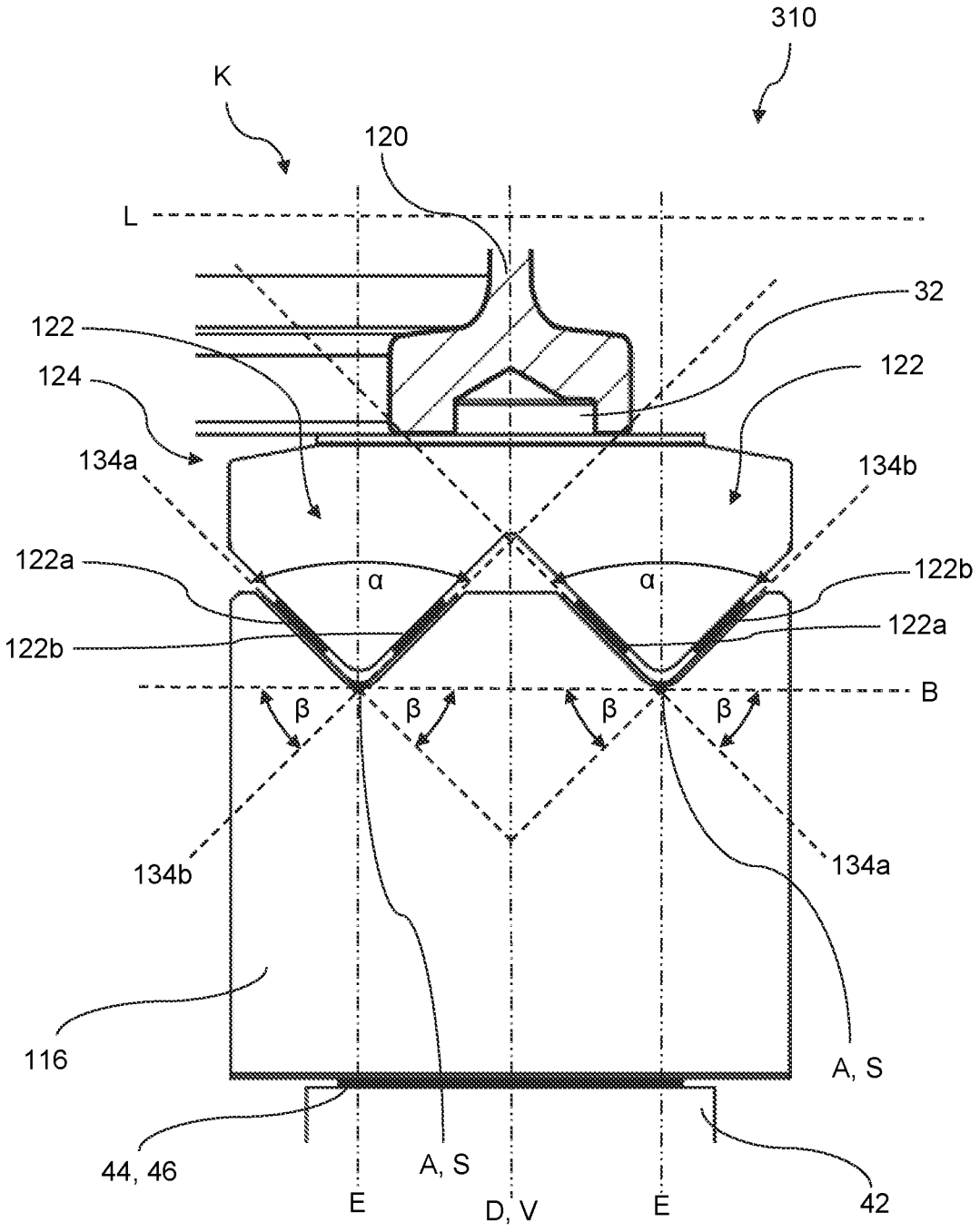
FIG. 9 is a section of an intersection point K of a transition structure according to a fifth embodiment.

FIG. 9 shows a section of an intersection point K of a slat 120 and a truss 116 of a transition structure 310 according to a fifth embodiment of the present invention. The transition structure 310 is substantially the same as the transition structure 110 of the third embodiment. The components of the same construction will not be further discussed below. Further, for clarity, not all details of the sliding bearing, truss and associated sliding surfaces in the figure are described.

The transition structure 310 differs from the transition structure 110 of the third embodiment in that two of the primary sliding surfaces 122, as described above, are arranged side by side between the truss 116 and the slat 120. In particular, the two primary sliding surfaces 122 are formed identically. Thus, the respective partial sliding surfaces 122*a* and 122*b* of the two primary sliding surfaces 122 are arranged such that the respective sliding planes 134*a* and 134*b* form the shape of an upside-down pitched roof. In this case, the two lines of intersection S and the two movement axes A of the two primary sliding surfaces 122 differ from each other, respectively. In this embodiment, the two axes of movement A are parallel to each other. Moreover, the two axes of movement A are arranged in the plane of movement B of the transition structure 310. The further primary sliding surface 122 further reduces the risk of a gap in the overall primary sliding surface at the intersection point K of the transition structure 310. At the same time, the slat 120 can move in the intersection point K with as little resistance as possible relative to the truss 116 due to the parallel arrangement of the two movement axes A relative to each other in the movement plane B.

The transition structure according to the invention can alternatively be designed as a guided cross-tie design for railroad bridge construction. Here, too, the basic principle of the described swivel truss design is applied.

REFERENCE SIGNS

10A, 10B,
110, 210, 310 Transition structure
12 Structure
12*a* First structure part
12*b* Second structure part
14 Structural joint
16, 116 Truss
18 Truss box
20, 120 Slat
20*a* Edge slat
22, 122 Primary sliding surface
22*a*, 122*a* Partial sliding surface
22*b*, 122*b* Partial sliding surface
22*c* Partial sliding surface
24, 124, 224 Sliding bearing
26, 126, 226 Base plate
28, 128, 228 Support plate
30, 130 Elastomeric layer
32 First trunnion
34*a*, 134*a* Sliding plane
34*b*, 134*b* Sliding plane
36 Sliding material
36*a*, 136*a* Sliding pad
36*b*, 136*b* Sliding pad
38*a*, 138*a* Sliding plate
38*b*, 138*b* Sliding plate
40 Bracket
42 Biasing unit
44 Horizontal sliding surface
46 Sliding material
48A Connecting element
48B Second trunnion
50 Upper sliding bearing
52 Lower sliding bearing
254 Shear surface
256 Shear surface
258 Plane
260 Plane
A Axis of movement
B Plane of movement
D Axis of rotation
E Plane of symmetry
S Line of intersection
K Intersection point
L Longitudinal axis
V Vertical axis
α First angle
β Second angle

What is claimed is:

1. A transition structure for bridging a structural joint between two structure parts of a structure, having at least two trusses mounted on the structure edges and at least one slat displaceably mounted thereon, a primary sliding surface being arranged between at least one truss and at least one slat, characterized in that the primary sliding surface has at least two partial sliding surfaces, each of which is arranged in mutually angled sliding planes, the sliding planes meeting in a common line of intersection(S) which forms an axis of movement (A) along which the slat can move relative to the truss, and at least one sliding plane being arranged at an oblique angle to a plane of movement (B) of the transition structure.

2. The transition structure according to claim 1, characterized in that the two sliding planes enclose a first angle (α) which is selected such that, in the state of use of the transition structure, no gap occurs in the area of the primary sliding surface.

3. The transition structure according to claim 2, characterized in that the first angle (α) is selected in such a way that, in the ultimate limit state of the transition structure, no gap occurs in the area of the primary sliding surface.

4. The transition structure according to claim 2, characterized in that the first angle (α) is between 60 degrees and 160 degrees, or at 90 degrees.

5. The transition structure according to claim 1, characterized in that the two sliding planes are arranged so that the line of intersection(S) is parallel to a longitudinal axis of a truss.

6. The transition structure according to claim 1, characterized in that several primary sliding surfaces are arranged along a truss and form a common axis of movement (A).

7. The transition structure according to claim 1, characterized in that the truss has at least one sliding plate in the area of the primary sliding surface.

8. The transition structure according to claim 1, characterized in that the truss is made of a sliding material, optionally wherein the sliding material is metallic.

9. The transition structure according to claim 1, characterized in that the primary sliding surface comprises a permanently lubricated sliding material, optionally wherein the lubricated sliding material comprises PTFE, UHMWPE, POM and/or PA.

10. The transition structure according to claim 1, characterized in that at least two partial sliding surfaces angled relative to one another are arranged in such a way that the corresponding sliding planes form the shape of a pitched roof.

11. The transition structure according to claim 1, characterized in that at least two partial sliding surfaces angled relative to one another are arranged in such a way that the corresponding sliding planes form the shape of an upside-down pitched roof.

12. The transition structure according to claim 1, characterized in that at least two partial sliding surfaces angled relative to one another are formed symmetrically relative to one another with respect to a plane of symmetry (E) extending through the line of intersection(S) in the vertical direction relative to the plane of movement (B).

13. The transition structure according to claim 1, characterized in that at least one sliding plane is inclined with respect to the plane of movement (B) by a second angle (β) between 10 degrees and 60 degrees, or with 45 degrees.

14. The transition structure according to claim 1, characterized in that the transition structure has at least one intersection point (K) of a slat with a truss, at which a sliding bearing, preferably rotatable about an axis (V) vertical to the plane of movement (B), with a support plate is arranged between the truss and the slat, the primary sliding surface extending between the truss and the support plate.

15. The transition structure according to claim 14, characterized in that the support plate is deformable so that the primary sliding surface has at least one partial sliding surface which is horizontal to the plane of movement (B) as a function of the magnitude of the applied load.

16. The transition structure according to claim 14, characterized in that the sliding bearing further comprises a base plate via which the sliding bearing is attached to the slat, and optionally wherein the slat or the base plate comprises a first trunnion via which the sliding bearing is rotatably attached to the slat.

17. The transition structure according to claim 16, characterized in that the sliding bearing further comprises an elastomeric layer disposed between the support plate and the base plate.

18. The transition structure according to claim 16, characterized in that the sliding bearing has at least one shear surface which is arranged in a plane between the support plate and the base plate, the plane being arranged at an oblique angle to the sliding planes of the partial sliding surfaces which are angled relative to one another.

19. The transition structure according to claim 14, characterized in that the transition structure has, in the area of at least one intersection point (K), a bracket arranged on the slat and having a biasing unit with a sliding material and the bracket and the biasing unit are designed in such a way that the slat is biased at the intersection point (K) with respect to the truss and is displaceable and/or is mounted rotatably about the axis (V) vertical to the plane of movement (B), and optionally wherein the sliding material is a sliding spring.

20. The transition structure according to claim 19, characterized in that the bracket has a second trunnion via which the biasing unit is rotatably attached to the bracket, wherein the first trunnion and the second trunnion form a common axis of rotation (D) and the slat is rotatably mounted about the axis of rotation (D) with respect to the truss at the intersection point (K).

21. The transition structure according to claim 19, characterized in that the biasing unit is designed to be guide-neutral for movements of the slat relative to the truss along the primary sliding surface.

22. The transition structure according to claim 19, characterized in that the sliding material of the biasing unit comprises a permanently lubricated sliding material, optionally wherein the lubricated sliding material comprises PTFE, UHMWPE, POM and/or PA.

23. The transition structure according to claim 19, characterized in that the biasing unit has a screw for biasing the biasing unit in an installed state.

24. The transition structure according to claim 19, characterized in that the biasing unit is designed in such a way that it can be installed biased and relieved to a predetermined biasing dimension in an installed state.

25. The transition structure according to claim 1, characterized in that the transition structure has at least one truss box in which one end of the truss is displaceably and/or rotatably mounted.

26. The transition structure according to claim 25, characterized in that the end of the truss has at least one bore and the truss box has at least one trunnion via which the end of the truss is mounted in the truss box.

27. The transition structure according to claim 25, characterized in that the truss box comprises an upper sliding bearing arranged above the truss, wherein a primary sliding surface is arranged between the upper sliding bearing and the truss.

28. The transition structure according to claim 27, characterized in that the upper sliding bearing is rotatably attached to the truss box.

29. The transition structure according to claim 27, characterized in that the upper sliding bearing is a sliding spring.

30. The transition structure according to claim 1, characterized in that the transition structure is a swivel truss design.

31. The transition structure according to claim 1, characterized in that the transition structure is a guided cross-tie design for railroad bridge construction.

32. The transition structure according to claim 1, characterized in that a plurality of, preferably two, primary sliding surfaces, whose axes of movement (A) differ from one another, are arranged between a truss and a slat.

33. The transition structure of claim 32, characterized in that the axes of movement (A) are parallel to each other and are preferably arranged in the plane of movement (B) of the transition structure or in a plane parallel thereto.

* * * * *